US009929495B2

(12) United States Patent
Iida

(10) Patent No.: US 9,929,495 B2
(45) Date of Patent: Mar. 27, 2018

(54) WATERPROOF CONNECTOR

(71) Applicant: Sumitomo Wiring Systems, Ltd., Yokkaichi, Mie (JP)

(72) Inventor: Koji Iida, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/485,587

(22) Filed: Apr. 12, 2017

(65) Prior Publication Data

US 2017/0317442 A1 Nov. 2, 2017

(30) Foreign Application Priority Data

Apr. 27, 2016 (JP) ..... 2016-089241

(51) Int. Cl.
*H01R 13/52* (2006.01)

(52) U.S. Cl.
CPC ..... *H01R 13/5219* (2013.01); *H01R 13/5202* (2013.01)

(58) Field of Classification Search
CPC . H01R 13/5219; H01R 13/5221; H01R 13/52
USPC ..... 439/271–277
See application file for complete search history.

(56) References Cited

U.S. PATENT DOCUMENTS 4,820,181 A * 4/1989 Kuzuno ..... H01R 13/5219 439/272
5,248,263 A * 9/1993 Sakurai ..... H01R 13/5219 439/271
5,779,493 A * 7/1998 Tomita ..... H01R 13/5219 439/271
6,368,130 B1 * 4/2002 Fukuda ..... H01R 13/52 439/271
6,517,368 B2 * 2/2003 Hara ..... H01R 13/521 439/271
2004/0063349 A1 * 4/2004 Sakiyama ..... H01R 13/5219 439/271
2007/0197069 A1 * 8/2007 Iwahori ..... H01R 13/5219 439/157

FOREIGN PATENT DOCUMENTS

JP 2014-139873 7/2014

* cited by examiner

*Primary Examiner* — Gary Paumen
(74) *Attorney, Agent, or Firm* — Gerald E. Hespos; Michael J. Porco; Matthew T. Hespos

(57) ABSTRACT

A waterproof connector (10) has a terminal accommodating portion (20) on which a seal ring (40) is to be fit. Seal mounting walls (36) project out from the terminal accommodating portion (20) and include locking holes (37) through which projections (43) of the seal ring (40) are press-fit from the front. Seal protection walls (33) are arranged behind the seal mounting walls (36) and projection accommodation spaces (S) are provided between the seal mounting walls (36) and the seal protection walls (33) for accommodating the projections (43). The seal protection walls (33) cover the projections (43) from behind so that the projections (43) cannot be pushed forward, cut or damaged by an impact from behind. Accordingly, the seal ring (40) will not be separated inadvertently and sealing performance can be maintained.

7 Claims, 8 Drawing Sheets

WATERPROOF CONNECTOR

BACKGROUND

1. Field of the Invention

This specification relates to a waterproof connector.

2. Description of the Related Art

Japanese Unexamined Patent Publication No. 2014-139873 discloses a waterproof female connector. This female connector includes a female housing with a terminal accommodating portion and a receptacle arranged around the terminal accommodating portion. A seal ring made of rubber is fit on the outer periphery of the terminal accommodating portion and a rearwardly tapered head is provided on a rear part of the seal ring. A locking hole penetrates through a back wall of the receptacle and the head of the seal ring is inserted tightly through the locking hole. The head is locked to an edge of the locking hole from behind to hold the seal ring. However, the head of the seal ring is exposed to the rear side in the above configuration. Thus, the seal ring may come off if the head portion is pushed forward upon receiving an impact from outside. Further, the seal ring may come off also if the head is cut or broken due to an impact from outside. Sealing performance is reduced if the seal ring comes off.

SUMMARY

The invention relates to a waterproof connector with a terminal accommodating portion. A seal ring is mounted on the terminal accommodating portion and includes a projection. The connector includes a seal mounting wall with a locking hole through which the projection is press-fit from the front. A seal protection wall is behind the seal mounting wall, a projection accommodation space for accommodating the projection is provided between the seal mounting wall and the seal protection wall. The seal protection wall covers the projection from behind. Thus, the projection cannot be pushed forward, cut or damaged by an impact from behind. Therefore, the seal ring will not come off and sealing performance can be maintained.

Upper edge parts of the seal mounting wall and the seal protection wall may be coupled by a ceiling wall. Accordingly, the projection is covered from above by the ceiling wall and cannot be cut or damaged by an impact from above.

Side edge parts of the seal mounting wall and the seal protection wall may be coupled by a side wall. Accordingly, the projection is covered laterally by the side wall, and the projection cannot be cut or damaged by a lateral impact.

A hand grip may be provided on a receptacle and the side wall may be in an area that includes a rear part of the hand grip. Thus, a finger can be placed from the hand grip to the side wall when hand holding the waterproof connector. Thus, the waterproof connector is held more easily.

DETAILED DESCRIPTION

Figure 4:
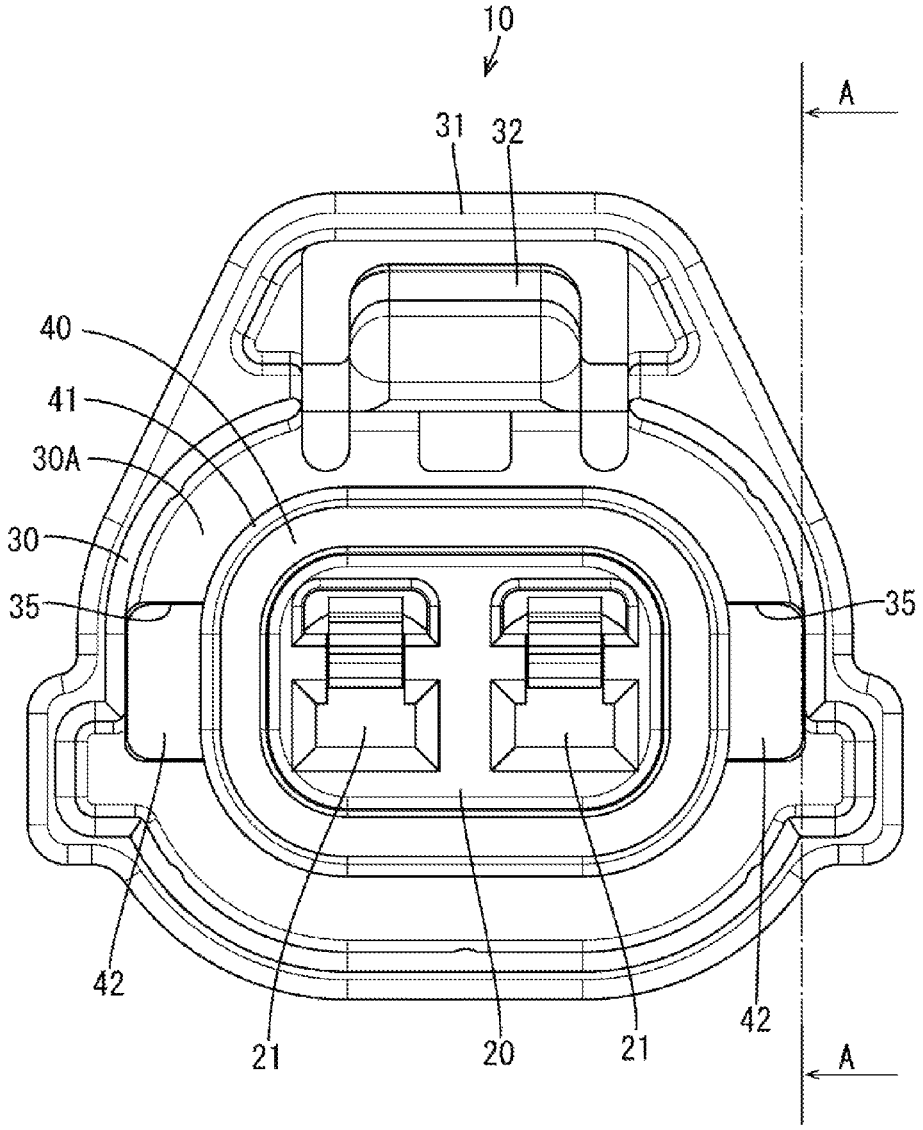
FIG. 4 is a front view of the waterproof connector.
Figure 5:
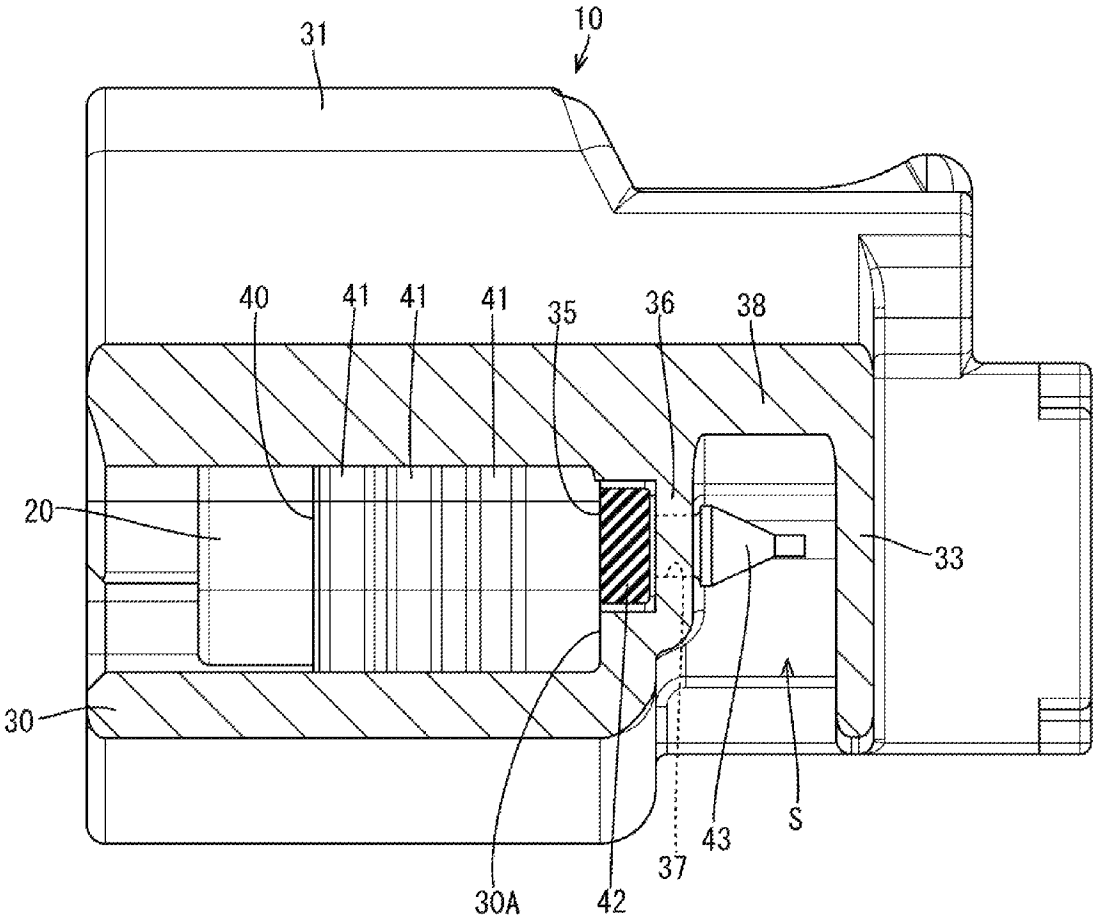
FIG. 5 is a section along A-A in FIG. 4.
Figure 6:
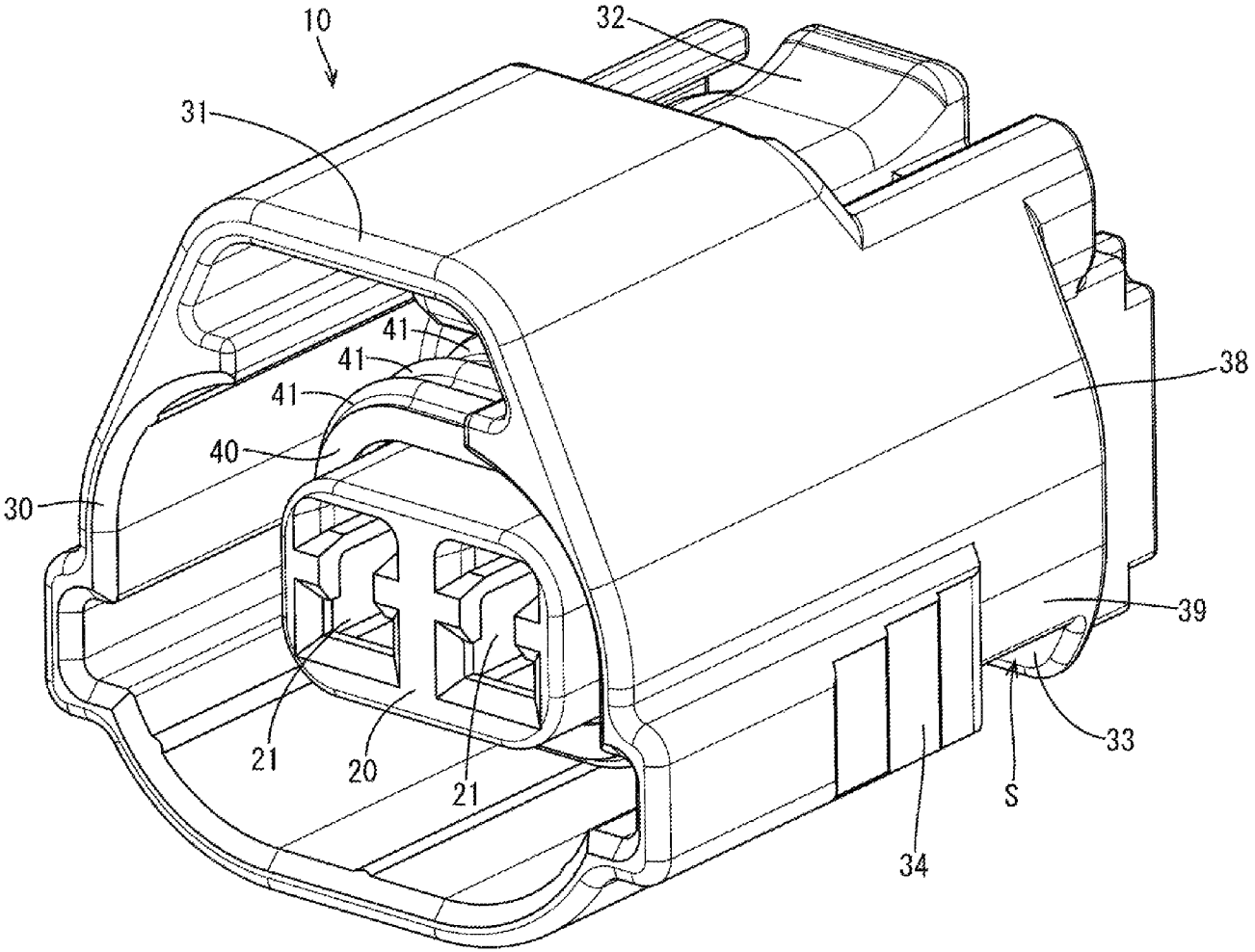
FIG. 6 is a view of the waterproof connector viewed obliquely from front.

A waterproof connector 10 in accordance with this disclosure is described with reference to FIGS. 1 to 8. The waterproof connector 10 includes a terminal accommodating portion 20 formed with cavities 21 and a receptacle 30 is provided on the outer periphery of the terminal accommodating portion 20. A seal ring 40 made of rubber is arranged between the terminal accommodating portion 20 and the receptacle 30, as shown in FIG. 6. The waterproof connector 10 is connectable to an unillustrated mating connector. A connecting direction to the mating connector is referred to as a front-rear direction and an end to be connected to the mating connector is referred to herein as the front (left in FIG. 1).

The cavities 21 of the terminal accommodating portion 20 penetrate in the front-rear direction, and unillustrated female terminals are inserted into the cavities 21 from behind. As shown in FIG. 6, a front half of the cavity 21 is in the form of a rectangular hole and the female terminal is to be accommodated in this part. On the other hand, as shown in FIG. 7, a rear half of the cavity 21 is in the form of a circular hole and a rubber plug (not shown) is accommodated in this part to prevent the intrusion of water into the cavity 21 from behind.

Figure 7:
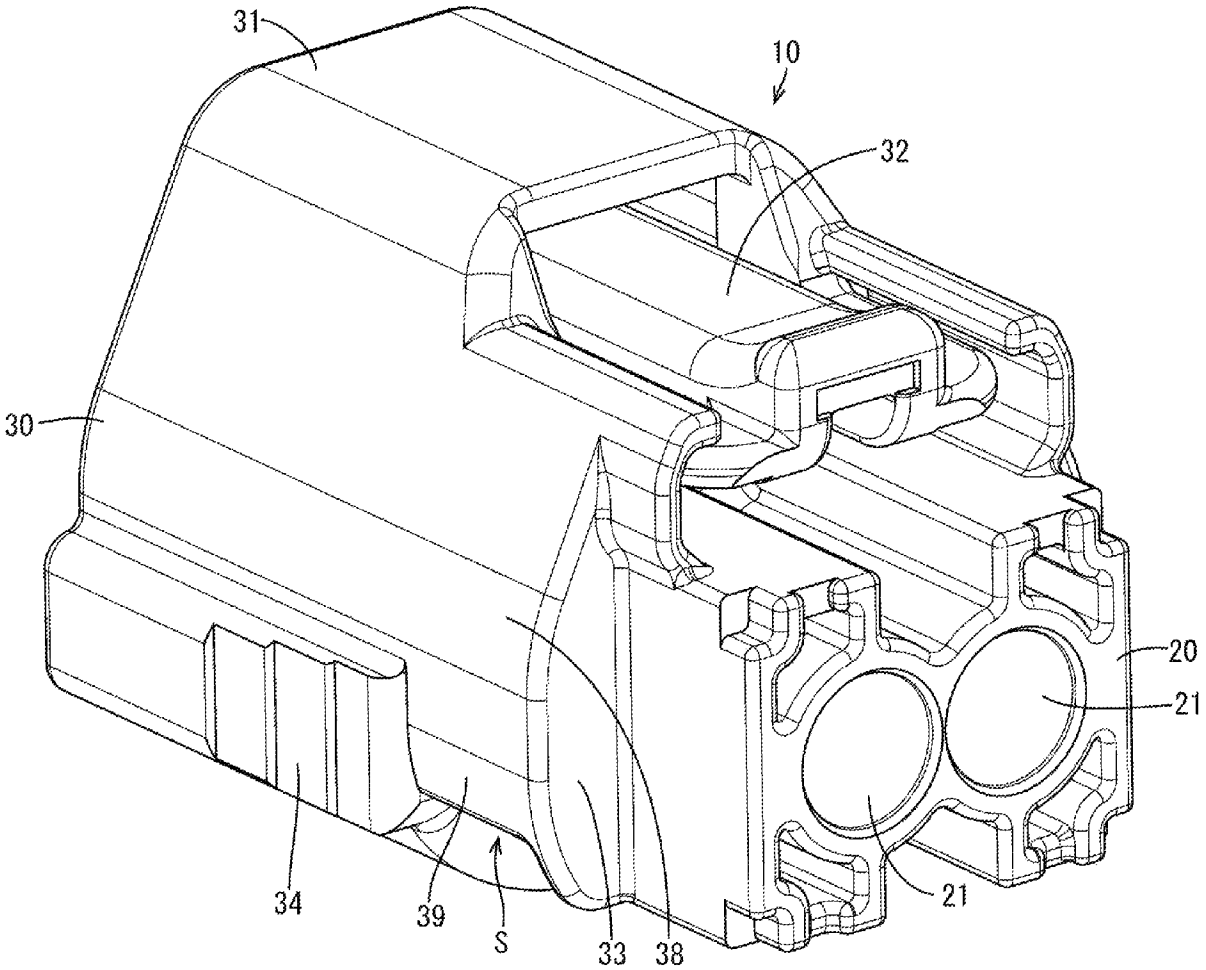
FIG. 7 is a view of the waterproof connector viewed obliquely from behind.

As shown in FIGS. 6 and 7, the receptacle 30 is open only forward and has a rear wall coupled to an outer peripheral side surface of the terminal accommodating portion 20.

A lock accommodating portion 31 is provided on top of the receptacle 30 and accommodates a lock 32 inside. The interior of the lock accommodating portion 31 is hollow in the front-rear direction. As shown in FIG. 6, the interior of the receptacle 30 and that of the lock accommodating portion 31 communicate with each other.

Hand grips 34 are provided on both left and right sides of the receptacle 30. Each hand grip 34 is shaped in a step-like manner to approach the inside of the receptacle 30 toward a rear, as shown in FIG. 7. Each hand grip portion 34 is a part on which a finger can be placed when connecting the waterproof connector 10 to the mating connector. The waterproof connector 10 can be connected to the mating connector by being pushed forward while fingers are placed on the hand grips 34.

As shown in FIG. 6, the seal ring 40 is fit on the outer peripheral surface of the terminal accommodating portion 20. Outer peripheral lips 41 are provided circumferentially on the outer peripheral surface of the seal ring 40. As shown in FIG. 4, the seal ring 40 has a substantially rectangular shape in conformity with the outer peripheral surface of the terminal accommodating portion 20. The seal ring 40 is sandwiched between the mating connector and the outer peripheral surface of the terminal accommodating portion 20 when the mating connector is fit between the terminal accommodating portion 20 and the receptacle 30 so that the interior of the terminal accommodating portion 20 is held in a sealed state.

Two mounting portions 42 are provided on short side edges of the seal ring 40. The mounting portions 42 are in the form of substantially rectangular flat plates in a front view and are fit into mounting recesses 35 provided on the back wall 30A of the receptacle 30 to position the seal ring 40 in a proper mounting posture. As shown in FIG. 5, the mounting portions 42 are provided on a rear end part of the seal ring 40.

A seal mounting wall 36 is provided at the rear end of the mounting recess 35 and a locking hole 37 penetrates through the seal mounting wall 36 in the front-rear direction behind the mounting recess 35. On the other hand, a projection 43 projects rearward on the rear surface of the mounting portion 42 of the seal rind 40. The projection 43 has a substantially conical shape tapered toward the rear. A maximum diameter part of the projection 43 located immediately behind the locking hole 37 is larger than a diameter of the locking hole 37. Thus, the projection 43 is press-fit into the locking hole 37 and locked. The projections 43 are reduced in diameter when passing through the locking holes 37, but resiliently return to be locked to edges of the locking holes 37 from behind so that the seal ring 40 is retained and held on the terminal accommodating portion 20.

Figure 3:
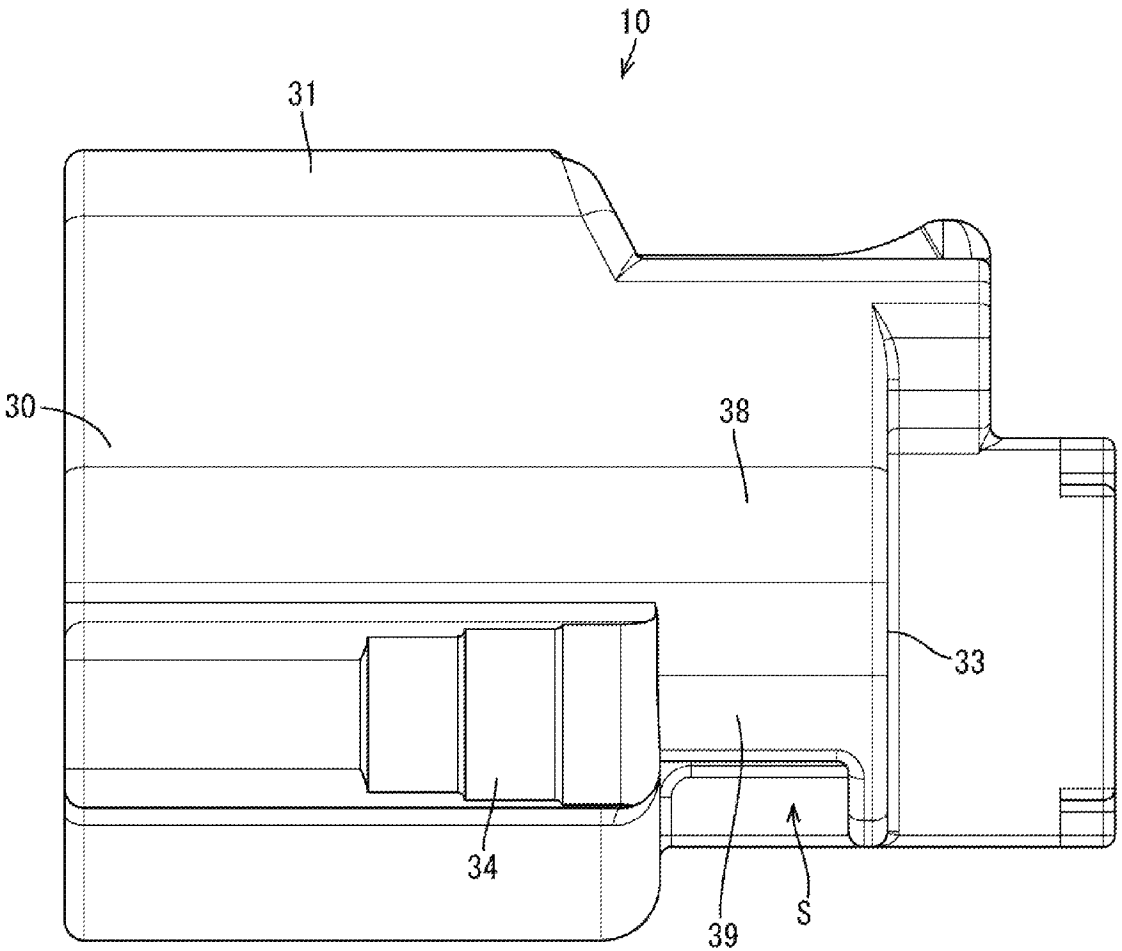
FIG. 3 is a side view of the waterproof connector.
Figure 8:
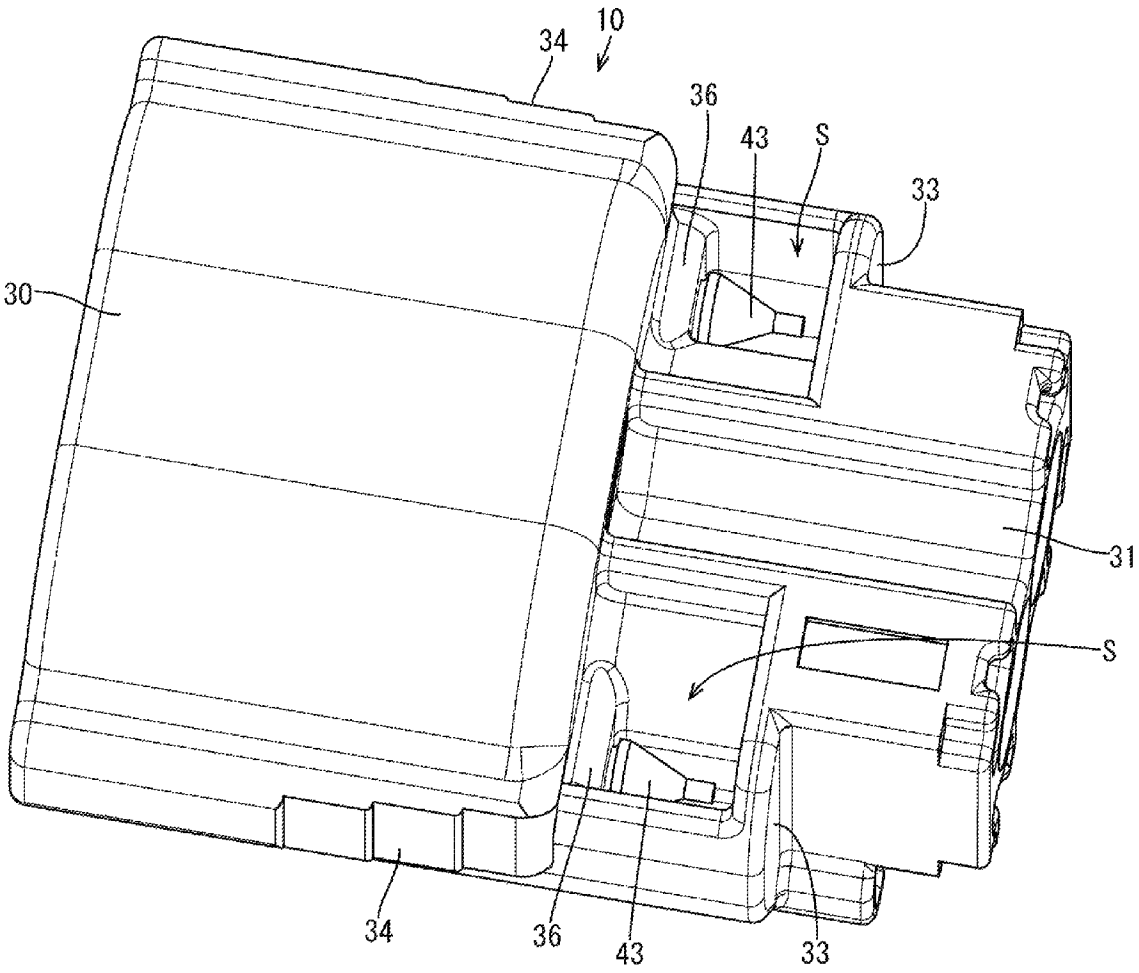
FIG. 8 is a view of the waterproof connector viewed obliquely from below.

Projection accommodation spaces S where the projections 43 of the seal ring 40 are accommodated are open only downward, as shown in FIG. 8. A seal protection wall 33 is defined at the rear of the projection accommodation space S serves as the seal protection wall 33. The seal protection wall 33 is located behind the seal mounting wall 36 and the seal protection wall 33 and the seal mounting wall 36 are arranged to face each other in the front-rear direction. Further, a ceiling wall 38 couples upper parts of the seal mounting wall 36 and the seal protection wall 33. Furthermore, a side wall 39 couples side parts of the seal mounting wall 36 and the seal protection wall 33. As shown in FIG. 6, the side wall 39 is flush with the receptacle 30 and connected to the rear end of the hand grip 34. As shown in FIG. 3, the lower end of the side wall 39 is located above that of the seal protection wall 33 and slightly above that of the hand grip 34.

Figure 1:
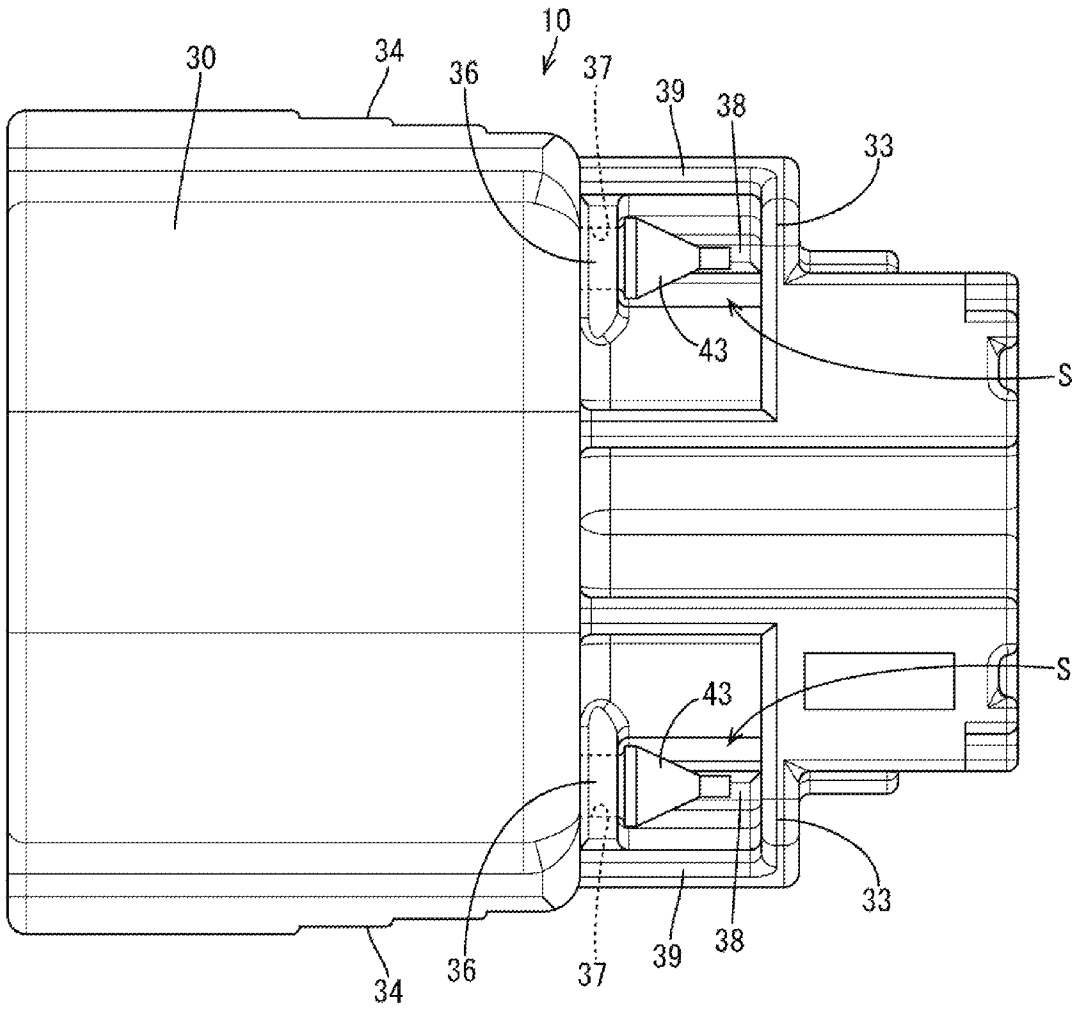
FIG. 1 is a bottom view of a waterproof connector in an embodiment.
Figure 2:
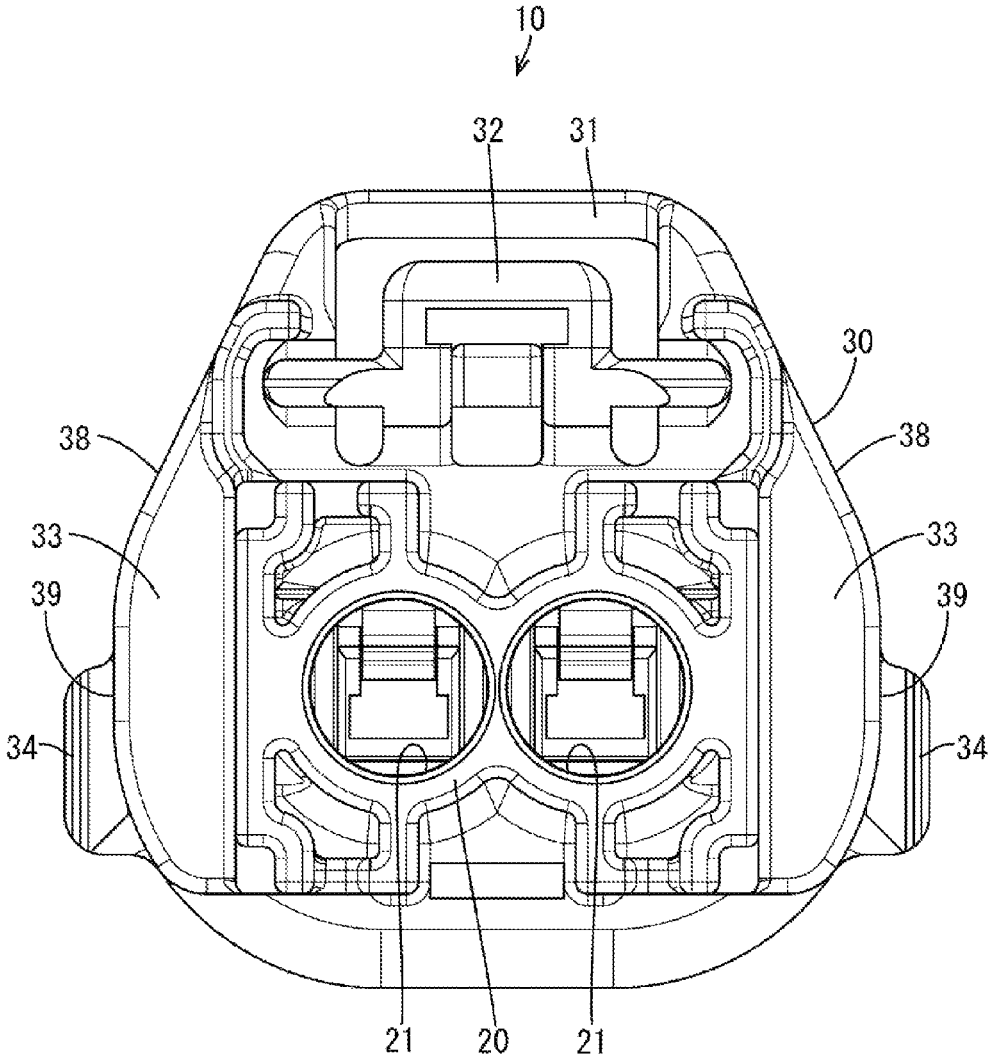
FIG. 2 is a back view of the waterproof connector.

Tips of the projections 43 are inserted into the locking holes 37 from the front as the seal ring 40 is fit onto an outer peripheral side of the terminal accommodating portion 20. As the projections 43 are pushed rearward while being compressed by inner walls of the locking holes 37, but resiliently return when passing through the locking holes 37. In this way, the projections 43 are locked to edges of the locking holes 37 from behind so that the seal ring 40 is held at a proper mount position. Proper mounting of the seal ring 40 can be confirmed visually by observing the projection accommodation spaces S from below, as shown in FIG. 1, to confirm that the projections 43 have returned to their natural state.

The projections 43 are protected from behind by the seal protection walls 33 so that the projections 43 cannot be pushed forward cut or damaged upon receiving an impact. Thus, the seal ring 40 will not come off the terminal accommodating portion 20. Further, a certain distance is ensured between an opening of the projection accommodation space S and the projection 43 so that a bar or the like cannot intrude through the opening of the projection accommodation space S to damage the projection 43.

As described above, the seal protection walls 33 cover the projection 43 from behind so that the projections 43 cannot be pushed forward, cut or damaged by an impact from behind. Thus, the seal ring 40 will not come off inadvertently, and sealing performance can be maintained.

The ceiling wall 38 couples upper parts of the seal mounting wall 36 and the seal protection wall 33 so that the projection 43 cannot be cut or damaged by an impact from above.

The side wall 39 couples side parts of the seal mounting wall 36 and the seal protection wall 33 may be coupled by the side wall 39 so that the projection 43 cannot be cut or damaged by a lateral impact.

The receptacle 30 may be provided with the hand grips 34 and the side walls 39 may be provided in areas including rear parts of the hand grips 34. According to this configuration, fingers can be placed from the hand grips 34 to the side walls 39 when holding the waterproof connector 10. Thus, the waterproof connector 10 is held more easily.

The invention is not limited to the above described and illustrated embodiment. For example, the following modes are also included.

The side walls 39 and the ceiling walls 38 are illustrated (projection accommodation spaces S open only downward) in the above embodiment, but it is sufficient to provide only the seal protection walls 33. The side walls 39 and/or the ceiling walls 38 may not be provided.

The side walls 39 are flush with the receptacle 30 in the above embodiment, but may be connected to the receptacle 30 via steps.

Although the side walls 39 are provided behind the hand grips 34 in the above embodiment, side walls may be configured by hand grips.

LIST OF REFERENCE SIGNS

10 . . . waterproof connector
20 . . . terminal accommodating portion
30 . . . receptacle
33 . . . seal protection wall
34 . . . hand grip
36 . . . seal mounting wall
37 . . . locking hole
38 . . . ceiling wall
39 . . . side wall
40 . . . seal ring
43 . . . projection
S . . . projection accommodation space

What is claimed is:

1. A waterproof connector, comprising:

a seal ring including a projection;

a terminal accommodating portion on which the seal ring is to be fit;

a seal mounting wall projecting out from the terminal accommodating portion and including a locking hole through which the projection is press-fit from the front; and a seal protection wall behind the seal mounting wall, and a projection accommodation space between the seal mounting wall and the seal protection wall for accommodating the projection.

2. The waterproof connector of claim 1, further comprising a ceiling wall coupling upper parts of the seal mounting wall and the seal protection wall.

3. The waterproof connector of claim 2, further comprising a side wall coupling side parts of the seal mounting wall and the seal protection wall.

4. The waterproof connector of claim 3, further comprising a forwardly open receptacle on an outer periphery of the terminal accommodating portion and the side wall being flush with the receptacle.

5. The waterproof connector of claim 4, further comprising a hand grip on the receptacle and the side wall being in an area including a rear part of the hand grip.

6. The waterproof connector of claim 1, further comprising a side wall coupling side parts of the seal mounting wall and the seal protection wall.

7. The waterproof connector of claim 6, further comprising a forwardly open receptacle on an outer periphery of the terminal accommodating portion and the side wall being flush with the receptacle.

* * * * *